United States Patent [19]

Wise

[11] 4,231,361

[45] Nov. 4, 1980

[54] BREATHING APPARATUS FLOW DEVICE

[75] Inventor: Layton A. Wise, Washington, Pa.

[73] Assignee: Mine Safety Appliances Company, Pittsburgh, Pa.

[21] Appl. No.: 4,659

[22] Filed: Jan. 19, 1979

[51] Int. Cl.[3] ..... A62B 7/00

[52] U.S. Cl. ..... 128/202.26; 128/205.28; 222/83.5; 285/302; 285/133 R; 277/194; 277/201; 277/152; 277/165

[58] Field of Search ..... 128/191 R, 142 R, 202, 128/147, 142.6, 146.6, 202.26, 205.28; 222/83.5, 88; 285/133 R, 45, 302; 137/318; 277/194, 201, 202, 152, 165

[56] References Cited

U.S. PATENT DOCUMENTS 2,710,003 6/1955 Hamilton et al. ..... 128/191 R 3,399,548 9/1968 Burns ..... 285/302 X

*Primary Examiner*—Henry J. Recla

*Attorney, Agent, or Firm*—Brown, Flick & Peckham

[57] ABSTRACT

A breathing apparatus flow device has a hollow housing with a bottom opening to receive the upper end of a chemical canister neck, a side opening for connection to a breathing bag, and a top opening for connection to an exhalation tube. Slidably mounted in rigid downwardly extending tubular means in the housing is a hollow open end plunger that extends below the housing and is urged downwardly by a coil spring. A cylindrical resilient seal encircles the lower portion of the tubular means in engagement therewith and extends below it and inwardly into engagement with the plunger to seal the space between the tubular means and the plunger.

4 Claims, 3 Drawing Figures

BREATHING APPARATUS FLOW DEVICE

U.S. Pat. No. 3,675,296 shows breathing apparatus that has at its top a flow device in the form of a hollow open bottom housing provided with a side opening for connection to a breathing bag, and a top opening for connection to an exhalation tube leading from a facepiece. A hollow plunger is slidably mounted in tubular means inside the housing and has an open upper end and a perforated lower end for piercing the seal on a chemical canister that is moved up against the plunger. Upward movement of the plunger is resisted by a coil spring. Such a flow device is satisfactory, except that there may be leakage of air between the plunger and the tubular means in which it slides. Accordingly, it is an object of this invention to provide a seal that will prevent such leakage. Another object is to provide such a seal which is simple in construction and which can readily be applied to and removed from the flow device.

The preferred embodiment of the invention is illustrated in the accompanying drawings, in which FIG. 1 is a side view and vertical section through a flow device to which a chemical canister is about to be connected;

Figure 1:
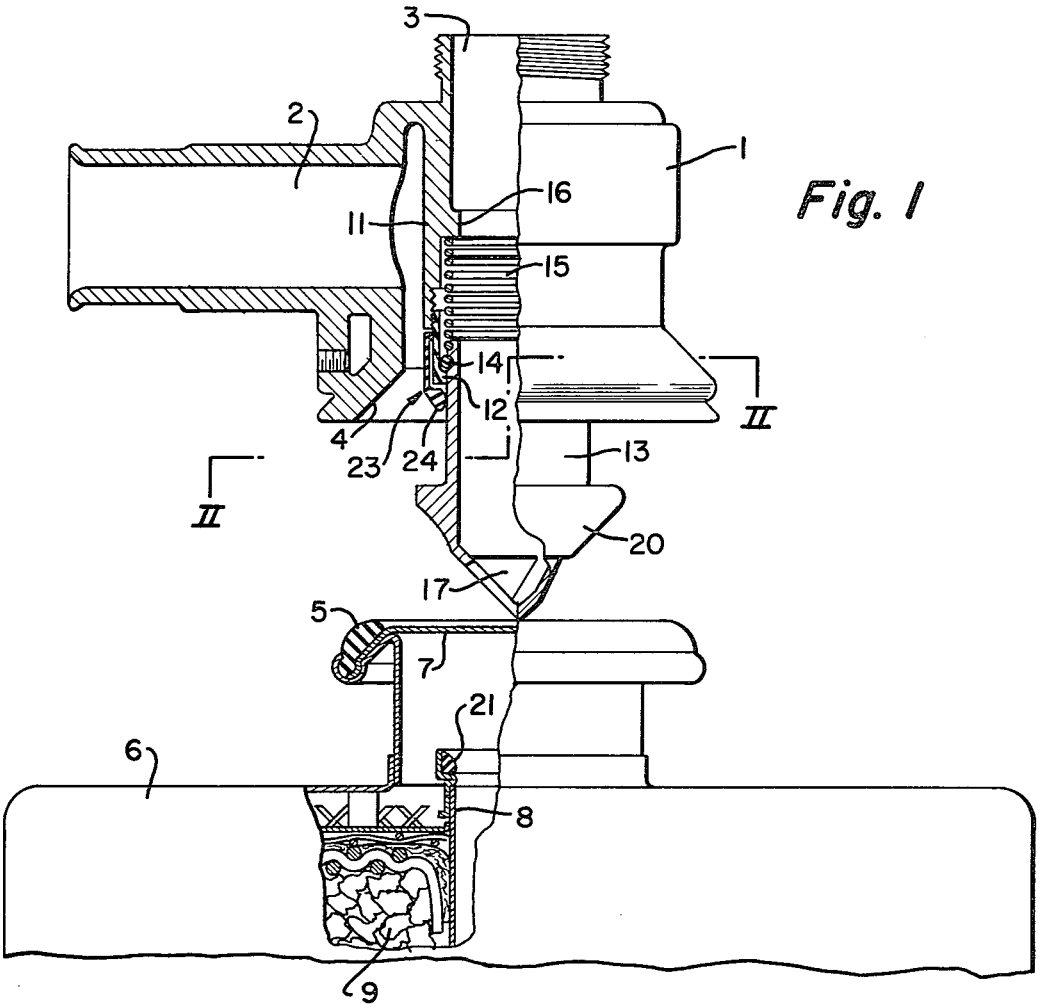
Figure 2:
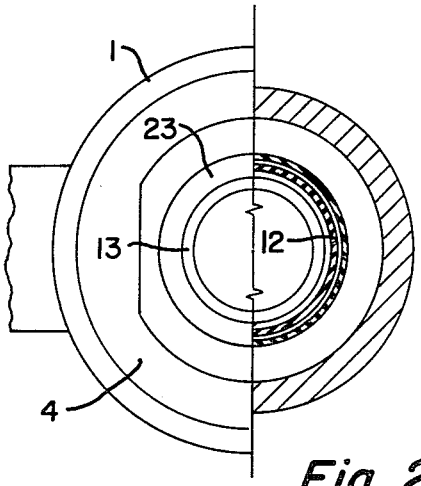
FIG. 2 is a horizontal section taken on the line II—II of FIG. 1.
Figure 3:
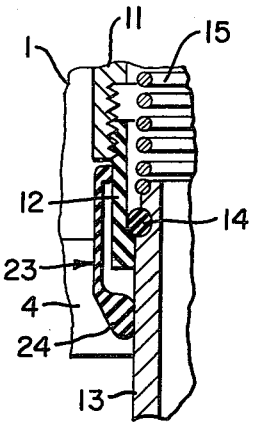
FIG. 3 is an enlarged fragmentary view of the sealed area.

Referring to the drawings, the flow device includes a hollow housing 1 having an opening 2 in one side for connection to a breathing bag (not shown). The top of the housing is provided with an opening 3 for connection to the exhalation tube (not shown) of a facepiece. The bottom of the housing is open and is provided with an upwardly tapered inner wall 4 for engagement by the sealing ring 5 on the upper end of the neck of a chemical canister 6. The canister normally is sealed by a copper foil disk 7 that closes the upper end of the neck. Inside the canister there is a rigidly mounted vertical tube 8 that extends downwardly from the lower part of the neck, through the granular chemical 9 in the canister and terminates a short distance above the bottom of the canister.

Inide housing 1 of the flow device there are tubular means extending downwardly from its top opening. These means consist of a tubular member 11 integral with the upper wall of the housing but spaced from its side wall, and a retaining ring 12 screwed into the lower end of this member and extending below it. A hollow plunger 13, open at its upper end, is slidably mounted in the retaining ring, where it is supported by a snap ring 14 mounted in an external groove in the upper end portion of the plunger. The snap ring normally rests on a shoulder near the lower end of the retaining ring. The plunger is urged downwardly and its upward movement is resisted by a coil spring 15 compressed between the upper end of the plunger and a shoulder 16 in tubular member 11 spaced some distance above the plunger. The lower end of the plunger is pointed and provided with perforations or holes 17.

When the canister is raised toward the flow device, the pointed lower end of plunger 13 punches through copper seal 7 and then a tapered shoulder 20 on the plunger seats on a sealing ring 21 on the upper end of tube 8. As the canister is moved further up, it slides the plunger up in housing 1 until the sealing ring 5 on the canister neck engages the tapered wall 4 of the housing.

Exhaled air can then flow down through the housing and plunger and the vertical tube in the canister and then up through the chemical in the canister and out through the neck around the plunger and then out of the housing through opening 2 and into a breathing bag. The flow device and its operation described thus far are conventional.

It is a feature of this invention that a seal is provided to prevent leakage of exhaled air between the plunger and retaining ring 12. Accordingly, a cylindrical seal 23 of resilient material, such as rubber or the like, encircles the retaining ring in tight engagement with it and extends a short distance below it. Preferably, the seal is held in place only by friction between it and the ring, caused by the seal having a stretch fit with the ring. The lower end of the seal below the retaining ring extends inwardly into engagement with the plunger. This lower end portion of the seal preferably is enlarged into the form of a bead 24 with a rounded surface engaging the plunger. With the seal tightly engaging the retaining ring and also the plunger, no air can flow between the plunger and ring.

The seal always stays in proper position. When a canister is applied to the flow device, forcing the plunger to move upwardly, friction forces between the seal and plunger increase but present no problem because the bead 24 is backed up by the lower end of the retaining ring. On the other hand, when the plunger returns from its upper to its lower position, the friction forces exerted by the seal on the plunger are relieved because the bead rolls downwardly with the plunger movement, whereby the diameter of the lower end of the seal is increased slightly. If necessary, the sealing member can be removed and a new one put in its place without any difficulty.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. A flow device for connecting a face piece and a breathing bag with a chemical canister having an upwardly extending neck closed by a sealing disk and also having a center tube extending downwardly in the canister from the neck, said flow device comprising a hollow housing provided with a top wall and a bottom opening that is encircled by a wall, means adapted to engage the upper end of said neck, the side of the housing having an opening therein for connection to a breathing bag, rigid tubular means in said housing extending through said top wall and joined thereto and having upper and lower ends, said upper end extending above said housing and having means for connection to an exhalation tube, said lower end being spaced inwardly from the side of said housing, a hollow plunger slidably mounted in said tubular means and extending down below the housing, means limiting downward movement of the plunger, coil spring means resisting upward movement of the plunger, the plunger having an open upper end and a perforated and pointed lower end for piercing said sealing disk when the hollow housing is pressed down on said neck, and a cylindrical resilient seal encircling the lower portion of said tubular means in tight engagement therewith and extending below it, the lower end of the seal below said tubular means being in the form of a bead extending inwardly into engagement with the plunger, whereby the space between the plunger and said tubular means is sealed against flow of air therethrough.

2. A flow device for connecting a face piece and a breathing bag with a chemical canister having an upwardly extending neck closed by a sealing disk and also having a center tube extending downwardly in the canister from the neck, said flow device comprising a hollow housing provided with a top wall and a bottom opening that is encircled by a wall, means adapted to engage the upper end of said neck, the side of the housing having an opening therein for connection to a breathing bag, a rigid tubular member extending through said top wall and joined thereto and having upper and lower ends, said upper end extending above said housing and having means for connection to an exhalation tube, said lower end being internally threaded and spaced inwardly from the side of said housing, a ring screwed into said tubular member and extending below it, a hollow plunger slidably mounted in said ring and extending down below the housing, means limiting downward movement of the plunger, coil spring means resisting upward movement of the plunger, the plunger having an open upper end and a perforated and pointed lower end for piercing said sealing disk when the hollow housing is pressed down on said neck, and a cylindrical resilient seal encircling said ring below said tubular member in tight engagement with the ring and extending below it, the upper end of the seal being adjacent the lower end of the tubular member, and the lower end of the seal below said ring extending inwardly into engagement with the plunger, whereby the space between the plunger and said ring is sealed against flow of air therethrough.

3. A flow device according to claim 2, in which said seal has a stretch fit with said ring.

4. A flow device according to claim 3, in which said inwardly extending lower end of said seal is in the form of a bead.

* * * * *